US005335948A

United States Patent [19]

Norton, II et al.

[11] Patent Number: 5,335,948

[45] Date of Patent: Aug. 9, 1994

[54] CYLINDRICAL LOCKSET

[75] Inventors: George H. Norton, II, Higganum; Damon J. Lenk, Bristol; James E. Robida, Cobalt, all of Conn.

[73] Assignee: Corbin Russwin, Inc., Berlin, Conn.

[21] Appl. No.: 962,538

[22] Filed: Oct. 16, 1992

[51] Int. Cl.[5] ..... E05C 1/12

[52] U.S. Cl. ..... 292/169.23; 292/336.3

[58] Field of Search ..... 292/169.16, 169.23, 292/337, 357, 336.3, 347, DIG. 61

[56] References Cited

U.S. PATENT DOCUMENTS

| | | | |
|---|---|---|---|
| 1,653,512 | 12/1927 | Schlage | 292/169.23 X |
| 2,470,770 | 5/1949 | Harvey | 292/153 X |
| 2,470,771 | 5/1949 | Harvey | 292/153 X |
| 3,954,292 | 5/1976 | Johnson | 292/169.17 |
| 4,042,268 | 8/1977 | Coglan | 292/307 |
| 4,123,097 | 10/1978 | Allemann | 292/336.3 |
| 4,202,575 | 5/1980 | Bates | 292/347 |
| 4,453,753 | 6/1984 | Fayerman et al. | 292/347 X |
| 4,569,547 | 2/1986 | Fayerman et al. | 292/DIG. 61 X |
| 5,123,682 | 6/1992 | Robida et al. | 292/337 X |

*Primary Examiner*—Rodney M. Lindsey
*Attorney, Agent, or Firm*—Darby & Darby

[57] ABSTRACT

A cylindrical lockset (20) includes an inside subassembly (22) and an outside subassembly (24) which are assembled with a door (208). Each subassembly (22, 24) includes a liner (26, 36), a rose (28, 38) and a lever (30, 40). A chassis assembly (58) includes a pair of sleeves (66, 68), a pair of spring plates (146, 192), a pair of torsion springs (166, 194), a cap (172), a case (182) and a retractor (70) which is coupled to the latchbolt (46). Upon operation of either of the levers (30, 40) from a non-operated or home position, the latchbolt (46) is retracted and the associated one of the springs (166, 194) is tensioned so that, upon release of the levers, the springs return the levers to the home position.

6 Claims, 4 Drawing Sheets 20
22
24
26
28
30
32
34
36
38
40
42
44
46
48
50
52
54
56
58
60
62
64
66
68
78
80
122
124
126
138
142
172
176
180
182
190
212
220
222
224
226
228
230
232
234
236
238
240
242
244
246
248
249
252

CYLINDRICAL LOCKSET

BACKGROUND OF THE INVENTION

This invention relates to a cylindrical lockset and particularly relates to a cylindrical lockset having a bias return for a lockset operator, such as a lever, assembled with a chassis of the lockset.

In many locksets, an operator, such as a knob or lever, is attached to components of a chassis to facilitate operation of the lockset and movement of a bolt associated therewith. Typically, a biasing element forms a portion of the lockset and is designed to develop a biasing tension when the operator is moved from a rest or home position so that, upon release of the operator, the operator will be returned to its home position.

Typically, a spring is mounted in a support housing in the form of a cassette and is located outside of the chassis. The spring is coupled through elements of the lockset to the operator and is biased upon operation of the operator to develop the stored return force necessary to return the operator to its home position upon release of the operator.

The spring-containing cassette is typically mounted externally of a housing of the cassette and, therefore, constitutes a separate component of the lockset which must be handled during assembly of the components of the lockset with a door or must be handled and manipulated when, for example, relocating the lockset on the door for the purpose of changing the hand of the door.

Thus, there is a need for a lockset which provides the necessary biasing force to return the operator to its home position but eliminates the need for handling separately any element, which provides such biasing force, during periods of assembly or re-assembly of the lockset with a door.

SUMMARY OF THE INVENTION

In view of the foregoing expressed need, it is an object of this invention to provide a cylindrical lockset having an operator-return component which does not require separate handling during assembly or reassembly of the lockset with a door.

Another object of this invention is to provide a cylindrical lockset having an operator-return component which can be assembled at the factory with other components of the lockset and does not require independent handling thereafter for packaging or assembly with a door.

With these and other objects in mind, this invention contemplates a cylindrical lockset mountable on a door which includes a latchbolt and a mechanism, contained within an enclosure, for moving the latchbolt between a latched position and an unlatched position. At least one sleeve extends from one side of the enclosure and is attached to the mechanism for operating the mechanism upon rotation of the sleeve. An operator is mounted on the sleeve for facilitating selective rotation of the sleeve. A force-developing structure is contained within the enclosure and is coupled through the sleeve to the operator. Upon movement of the operator form a non-operated position to an operated position, the structure develops a force which facilitates return of the operator to the non-operated position upon release thereof.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

Figures 1, 7:
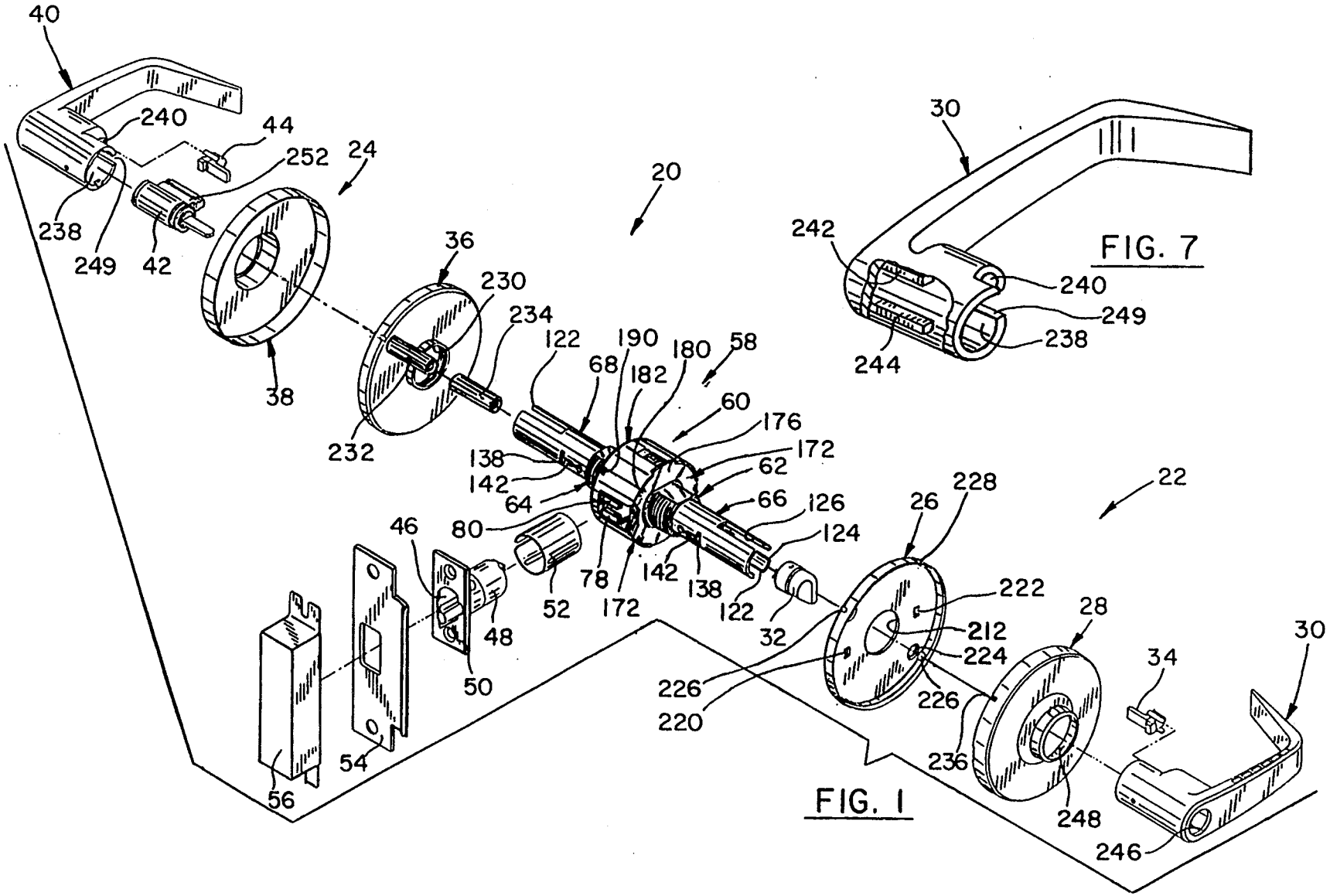
FIG. 1 is an exploded perspective view of a cylindrical lockset embodying certain principles of the invention.
FIG. 7 is a perspective view of a lever with portions broken away to show structure internally of the lever.

As illustrated in FIG. 1, a cylindrical lockset 20 includes an inside subassembly 22 and an outside subassembly 24. The inside subassembly 22 includes a liner 26, a rose 28, a lever 30, a turnbutton 32 and a lever insert 34. The outside subassembly 24 includes a liner 36, a rose 38, a lever 40, a cylinder lock 42 and a lever insert 44.

Cylindrical lockset 20 further includes a latchbolt 46 mounted within a casing 48 which is staked or attached to a face plate 50. An auxiliary casing 52 is provided for larger mounting holes. A strike 54 and strike box 56 are also illustrated.

A chassis assembly 58 also forms a portion of cylindrical lockset 20 and includes a housing 60, a pair of threaded sleeves 62 and 64 extending from opposite sides of the housing. A pair of rollback sleeves 66 and 68 extend through sleeves 62 and 64, respectively, and from housing 60.

Figure 3:
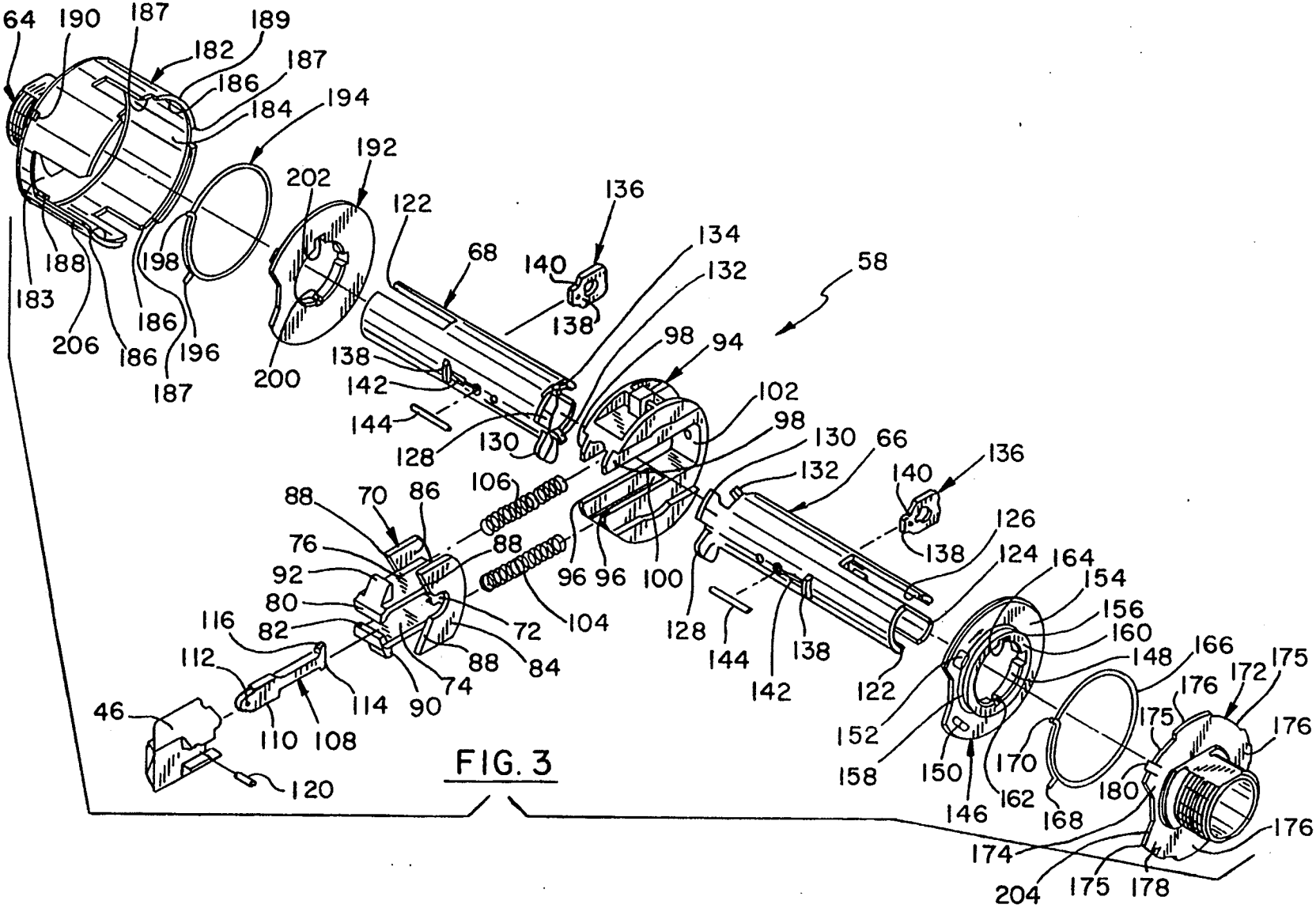
FIG. 3 is an exploded perspective view of various components of the cylindrical lockset of FIG. 1 including a latchbolt and retractor, a chassis with rollback sleeves and a force-developing structure all embodying certain principles of the invention.

Referring to FIG. 3, a retractor 70 is formed with a rear support 72 from which a pair of arms 74 and 76 extend. Arms 74 and 76 are formed at the free ends thereof with inwardly facing lips 78 and 80, respectively, which are separated to provide a space 82 therebetween. Retractor 70 is also formed with a pair of spaced sidewalls 84 and 86 having cam follower surfaces 88 formed thereon. A pair of walls 90 and 92 are located on outer surfaces of arms 74 and 76, respectively, adjacent the free ends thereof.

A retractor housing 94 is formed with lower rails 96 and upper rails 98 having associated rear walls 100 (one shown) all of which are integrally joined by a rear wall 102 of the retractor housing. A pair of springs 104 and 106 are captured between rear walls 100 of housing 94 and walls 90 and 92, respectively of retractor 70 when the retractor is moved into assembly with the housing. Also, when retractor 70 is assembled with housing 94, arms 74 and 76 are located adjacent rails 96 and 98, respectively. Further, sidewalls 84 and 86 are located outside of the sides of rails 96 and 98.

A link 108 is formed with a head end 110 having a hole 112 formed therethrough and cross arms 114 and 116 at a rear end 118 thereof. Head end 110 is assembled with latchbolt 46 by use of a pin 120 which extends through hole 112 and a hole (not shown) formed in the latchbolt. Cross arms 114 and 116 are located between arms 74 and 76, respectively, of retractor 70 and are retained with the retractor by lips 78 and 80, respectively. In this manner, retractor 70 is coupled to latchbolt 46 so that the latchbolt moves upon movement of the retractor.

Rollback sleeves 66 and 68 are each formed with three slots 122, 124 and 126 at the outboard ends of the sleeves. Slots 122 and 126 of each of sleeves 66 and 68 are diametrically opposed to each other while slot 124 is located approximately ninety degrees from slots 122 and 126 at one side of the sleeves. The inboard ends of each of sleeves 66 and 68 are formed with a pair of rollback cams 128 and 130. Also, a pair of vertically aligned, spaced tabs 132 and 134 are formed on rollback sleeves 66 and 68 at the inboard ends thereof.

A catch plate 136 having a reduced end 138 and a small hole 140 formed therethrough. Plate 136 is positioned through a slot (not shown) formed in the side of sleeve 66 so that end 138 protrudes slightly out of a T-shaped slot 142 on the other side of the sleeve. A pin 144 is positioned through the T-shaped slot 142 and the small hole 140 of plate 136 and serves to retain the plate with sleeve 66 in such a manner that end 138 extends in biased fashion through the T-shaped slot. This provides a spring-biased catch for lever 30 to retain the lever on sleeve 66. An identical catch arrangement is provided with respect to sleeve 68 by use of catch plate 136 and pin 144.

A spring plate 146 is generally circular in configuration and is formed with a central opening 148 for mounting the plate on sleeve 66. A pair of lugs 150 and 152 extend in spaced relation from an outboard face 154 of plate 146. Also, a hub 156 extends from outboard face 154 about opening 148 and has an annular groove 158 formed therein between face 154 and an outboard rim 160 of the hub. A pair of diametrically opposed, vertically spaced slots 162 and 164 are formed in plate 146 and communicate with opening 148.

A torsion spring 166 is circular in configuration and is formed with two outwardly turned free ends 168 and 170.

A cap 172 is formed by a plate 174 having peripheral edges 175 and radially extending projections 176 spaced about the periphery thereof. A pair of spaced tabs 178 and 180 are formed in plate 174 adjacent the periphery of the plate and are angled in an inboard direction toward spring plate 146. Threaded sleeve 62 is staked or secured to plate 174 in the arrangement shown in FIG. 3.

Housing 60 is formed by cap 172 and a case 182 which is formed with an opening 184 on one side. An annular groove 186 is formed within case 182 just inside opening 184 which is interrupted by spaced notches 187 formed in an inboard edge 189 of the case. The other side of case 182 is formed with a wall 183 having a central opening (not shown) about which threaded sleeve 64 is staked or secured to the wall. A pair of tabs 188 and 190 are formed in wall 183 in the same manner as tabs 178 and 180 are formed in plate 174.

A spring plate 192, identical in configuration to plate 146, and a torsion spring 194 with ends 196 and 198, which is identical in configuration to spring 166, are arranged for assembly with sleeve 68.

Figure 4:
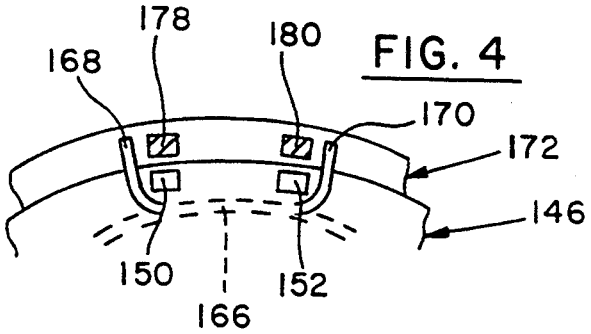
FIGS. 4, 5 and 6 are partial front views showing various positions of elements of the force-developing structure of FIG. 3.

In assembly of chassis assembly 58, spring 166 is positioned over hub 156 of plate 146 so that ends 168 and 170 are located radially outboard of lugs 150 and 152, respectively, as shown in FIG. 4. Cap 172 is located adjacent rim 160 of plate 146 with ends 168 and 170 being located radially outboard of tabs 178 and 180 also as shown in FIG. 4. Further, spring 166 is now captured loosely between plates 146 and 174 and is loosely positioned about but not fully seated in annular groove 158 formed in hub 156. Thus, hub 156 serves to maintain spring 166 in a generally axial arrangement with plate 146 and cap 172.

The assembly of plate 146, spring 166 and cap 172 are now placed onto sleeve 66 and moved to the inboard end of the sleeve whereby slots 162 and 164 of the plate are located over tabs 134 and 132, respectively. In this manner, spring plate 146 is coupled to rollback sleeve 66 for rotation therewith.

In similar fashion, spring plate 192, spring 194 and case 182 are assembled so that the spring is captured between wall 183 and spring plate 192. The assembly of the plate 192, spring 194 and case 182 are positioned on rollback sleeve 68 so that tabs 132 and 134 are located in slots 200 and 202, respectively, of the plate.

Also, peripheral edges 175 of cap 172 snap into groove 186 of case 182 so that the cap and case are held together to form housing 60 (FIG. 1). Further, projections 176 of cap 172 fit into notches 187 of case 182 to preclude rotation of the cap relative to the case.

Figure 2:
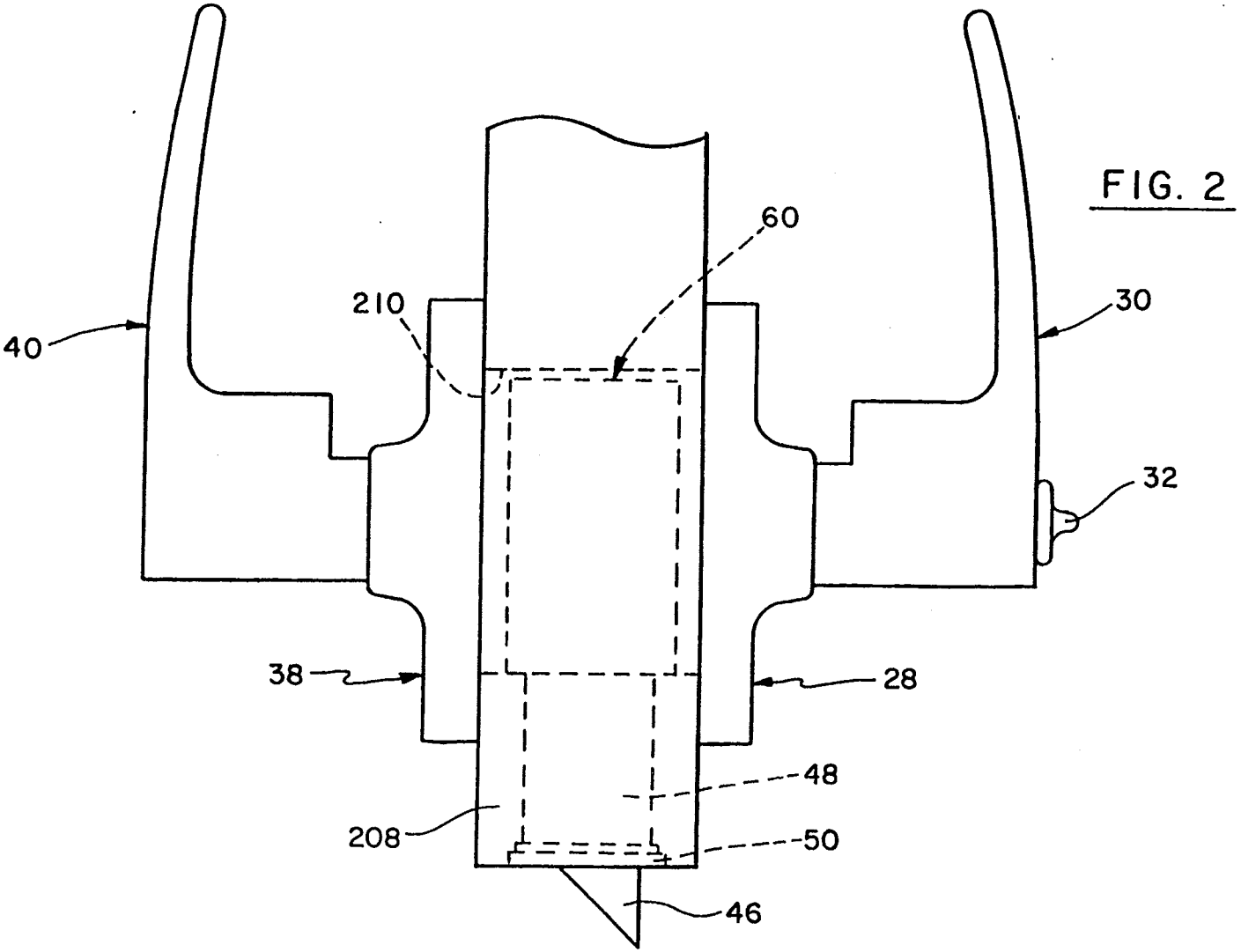
FIG. 2 is a plan view of the cylindrical lockset of FIG. 1 in assembly with a door.

During the assembly process, retractor 70 is assembled with housing 94 and springs 104 and 106 as previously described without link 108 being coupled to the retractor. In this manner, retractor 70 and retractor housing 94 are also contained within chassis housing 60 formed by cap 172 and case 182. Cap 172 is formed with a wide notch 204 which aligns with an opening 206 in case 182 when chassis housing 60 is formed and which allows lips 78 and 80, as well as space 82, to appear at opening 206. Cross arms 114 and 116 can be inserted through notch 204 of cap 172 and into coupling arrangement with retractor 70 as previously described. This is typically accomplished when cylindrical lockset 20 is being assembled with a door 208 as shown in FIG. 2.

The chassis assembly 58 is then positioned as shown in FIG. 1 and assembled with an opening 210 (FIG. 2) of door 208. Latchbolt 46 and link 108 are then assembled with the chassis assembly 58 as previously described. Inside liner 26 is then positioned onto sleeve 66 by virtue of a central opening 212 and is placed against the inside surface of door 208. In addition, a pair of anti-rotation tabs 220 and 222 locate in holes (not shown) in door 208. Further, two holes 224 formed in liner 26 align with two holes (not shown) which have been formed in door 208. Inwardly projecting dimples 226 are formed in an inboard portion of a rim 228 of liner 26.

Outside liner 36 is formed with a central opening 230 which facilitates positioning of the liner onto sleeve 68. A pair of internally threaded posts 232 and 234 are staked to and extend from the inboard side of liner 36. When outside liner 36 is positioned on sleeve 68 and against the outside surface of door 208, posts 232 and 234 align with the above-noted two holes 224 formed in inside liner 26. A pair of screws (not shown) are then placed through the aligned holes 224 and into threaded posts 232 and 234 to draw liners 26 and 36 toward each other with door 208 therebetween. This positions and secures chassis assembly 58 in proper orientation and location with respect to door 208.

Inside rose 28 is placed over liner 26 so that inwardly projecting dimples 236 of the rose snap into dimples 226 of the liner to thereby align and retain the liner with the rose. Rose 38 is assembled onto sleeve 68 and with liner 36 in similar fashion.

As shown in FIG. 7, lever 30 is formed with a first opening 238 and a second opening 240 which communicates with opening 238. A pair of ribs 242 and 244 are formed within opening 238. As shown in FIG. 1, an opening 246 is formed in an outer face of lever 30 and communicates with opening 238 thereof.

After rose 28 has been assembled with liner 26 on door 208, the outboard end of rollback sleeve 66 extends from a central opening 248 of the rose. Lever 30 is then manipulated to position opening 238 over sleeve 66 so that ribs 242 and 244 are positioned into slots 122 and 126, respectively, of the sleeve. Also, end 138 of catch plate 136 is biased into a complementary recess (not shown) within opening 238 of lever 30 to facilitate retention of the lever with sleeve 66. Insert 34 is placed within opening 240 and a slot 249 of lever 30 to provide a decorative exterior.

Turnbutton 32 is mounted within an opening 250 at the outboard end of sleeve 66 with the outboard end of the turnbutton projecting outwardly from opening 246 of lever 30 to provide access thereto. Turnbutton 32 can be used to lock or unlock cylindrical lockset 20 in a conventional manner.

Cylinder lock 42 is formed with a chimney 252 which is inserted into side slot 124 of sleeve 68 when the cylindrical portion of the lock is inserted into the central opening of the sleeve. Lever 40 is then assembled with sleeve 68 in the same manner as the assembly of lever 30 with sleeve 66. During the assembly operation, slot 249 of lever 40 allows chimney 252 to be located in opening 240 of the lever. Thereafter, insert 44 is positioned within opening 240 and over slot 249 to provide a decorative cover.

Referring to FIG. 4, when lever 30 is in the non-operated or home position, end 168 of spring 166 is located on the outboard sides of lug 150 and tab 178 and end 170 of the spring is located on the outboard sides of lug 152 and tab 180. Referring to FIG. 3, when lever 30 is operated, that is rotated in a first direction, sleeve 66 is rotated to move cams 128 and 130. Depending on the direction of rotation, one of the cams 128 or 130 will engage an associated one of the cam follower surfaces 88 or retractor 70 to move the retractor further into retractor housing 94 against the biasing action of springs 104 and 106. This structure provides a mechanism the operation of which results in movement of latchbolt 46 from a latched position (FIG. 2) to an unlatched position. In this manner, latchbolt 46 is drawn substantially within case 48 so that no portion of the latchbolt extends beyond the adjacent edge of door 208. It is noted that chassis housing 60 provides an enclosure for the mechanism which moves latchbolt 46.

Figure 5:
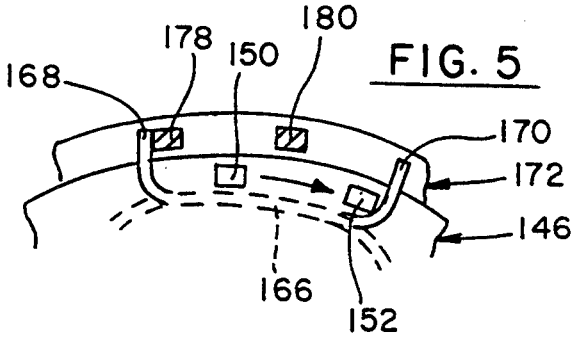

When lever 30, which is an operator of cylindrical lockset 20, is moved in the first direction from its home position, a force-developing structure is operated to develop a force which will facilitate the return of the lever to the home position when the lever is released. Referring to FIGS. 3 and 5, the force-developing structure includes spring plate 146, torsion spring 166 and tabs 178 and 180 of cap 172. In particular, when sleeve 66 is rotated upon operation of lever 30 in the direction indicated in FIG. 5, plate 146 is moved to move lugs 150 and 152 therewith. Lug 152 engages end 170 of spring 166 while end 168 of the spring engages fixed tab 178 of cap 172. This action results in tensioning of spring 166 which develops stored energy within the spring. It is noted that the diameter of the convolution of spring 166 is reduced as the spring is tensioned whereby the convolution is allowed to move further into annular groove 158 of hub 156.

When lever 30 is released, the stored energy within torsion spring 166 is released to apply a force from end 170 of the spring against lug 152 of plate 146 to move the plate in direction which is the reverse of the direction indicated in FIG. 5. This action causes sleeve 66 to rotate in the reverse direction and to move and return lever 30 to its home position.

Figure 6:
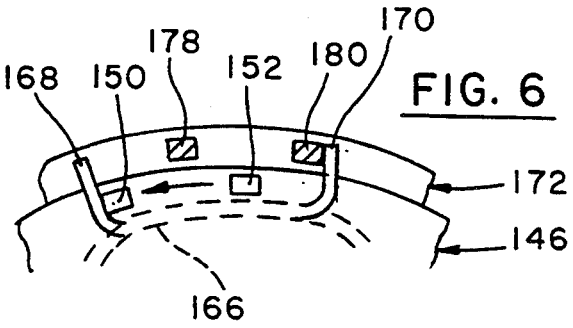

Referring to FIG. 6, if lever 30 could be and is operated in a second direction, which is the opposite of the first direction, plate 146 is rotated in the direction shown. In this manner, lugs 150 and 152 are moved whereby lug 150 engages and moves end 168 of spring 166. End 170 of spring 166 engages tab 180 and is precluded from movement with end 168 whereby the spring is tensioned. Upon release of lever 30, the reverse process occurs whereby stored energy in tensioned spring 166 develops a force which results in the return of the lever to its home position.

The operation of lever 40 and its associated force-developing structure would be accomplished in the same manner as that described above with respect to lever 30.

It is noted that, typically, lever 30 and lever 40 would be operable from its home position in one direction only, that direction usually being a downward direction. In this instance, the force-developing structure associated with lever 30 of a given cylindrical lockset 20 would operate only as illustrated in FIG. 5. The force-developing structure associated with lever 40 of the same cylindrical lockset 20 would operate only in the manner illustrated in FIG. 6.

Due to the versatility of spring plate 146 being rotatable in either direction, there is no need to relocate the plate and spring 166 when the hand of door 208 is changed, or when the inside-outside orientation of the door is changed.

In general, the above-described embodiment is not to be construed as limiting the breadth of the present invention. Modifications and other alternative constructions will be apparent which are within the spirit and scope of the invention as defined in the appended claims.

What is claimed is:

1. A cylindrical lockset comprising a latchbolt, a mechanism for moving the latchbolt between a latched position and an unlatched position, an axially aligned pair of rotatable sleeves operatively associated with said mechanism, a housing for said mechanism including a cylindrical shell having closed opposed ends each having an opening therein for receiving one of said rotatable sleeves, a pair of coil torsion springs inside said shell, one of said coil torsion springs received by each of said rotatable sleeves, and said received coil torsion springs located adjacent said closed ends, a pair of ring shaped plates inside said shell, one of said ring shaped plates received by each of said rotatable sleeves, said received ring shaped plates located adjacent said coil torsion springs so that each coil torsion spring is captured between one of said closed ends and one of said ring shaped plates, each rotatable sleeve and said ring shaped plate received thereon including cooperating key and keyway means for establishing a rotational connection therebetween so that rotation of said rotatable sleeve will rotate said rotationally connected ring shaped plate, and each ring shaped plate and adjacent closed end including cooperating tab means for subjecting said coil torsion springs to an increasing stress as said ring shaped plates are rotated.

2. A cylindrical lockset according to claim 1, wherein each of said ring shaped plates further comprises a ring shaped hub around which one of said coil torsion springs is located.

3. A cylindrical lockset according to claim 2, wherein an annular groove is defined in said hubs.

4. A cylindrical lockset according to claim 1, wherein one of said shell ends comprises a cap and said cylindrical shell includes an inner annular groove at one end for receiving said cap.

5. A cylindrical lockset according to claim 1, wherein said cooperating tab means comprising first tab means on each of said ring shaped plates extending axially towards said adjacent closed end, and second tab means on each of said closed ends extending axially towards said adjacent ring shaped plate, said first and second tab means being selectively radially located so as to be radially adjacent when said operator is at said latched position, and said coil torsion springs including radially extending ends engaging either side of said radially adjacent tab means at said latched position.

6. A cylindrical lockset, which comprises:

a latchbolt;

a shell-like case having an open interior and an open side;

a groove formed within the open interior of the case adjacent the open side thereof;

a cap formed with at least one projection along the periphery thereof and insertible into the groove of the case upon assembly of the cap with the case to retain the cap with the case and to form an enclosure;

a mechanism contained within the enclosure for moving the latchbolt between a latched position and an unlatched position;

at least one sleeve extending from one side of the enclosure and attached to the mechanism for operating the mechanism; and an operator mounted on the sleeve for facilitating selective rotation of the sleeve.

* * * * *